US010810949B2

(12) United States Patent
Huang

(10) Patent No.: US 10,810,949 B2
(45) Date of Patent: Oct. 20, 2020

(54) SIGNAL PROCESSING METHOD AND DISPLAY DEVICE

(71) Applicant: AU Optronics Corporation, Hsin-Chu (TW)

(72) Inventor: Chun-Chieh Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/520,414

(22) Filed: Jul. 24, 2019

(65) Prior Publication Data

US 2020/0234657 A1 Jul. 23, 2020

(30) Foreign Application Priority Data

Jan. 17, 2019 (TW) ..... 108101872 A

(51) Int. Cl.
*G09G 3/36* (2006.01)
*G09G 3/34* (2006.01)

(52) U.S. Cl.
CPC ..... *G09G 3/3406* (2013.01); *G09G 3/3607* (2013.01); *G09G 2320/0233* (2013.01); *G09G 2320/0242* (2013.01); *G09G 2320/0646* (2013.01); *G09G 2360/16* (2013.01)

(58) Field of Classification Search
CPC ..... G09G 3/3406; G09G 3/3607
USPC ..... 345/102
See application file for complete search history.

(56) References Cited

U.S. PATENT DOCUMENTS 9,183,796 B2 11/2015 Lin et al.
2012/0287148 A1* 11/2012 Brown Elliott ..... G09G 3/3426 345/593
2012/0287168 A1* 11/2012 Botzas ..... G09G 3/3413 345/690
2014/0022271 A1* 1/2014 Lin ..... G09G 3/36 345/589
2019/0348001 A1 11/2019 Shi et al.

FOREIGN PATENT DOCUMENTS

CN 108428436 A 8/2018
TW I649600 B 2/2019

* cited by examiner

*Primary Examiner* — Kwin Xie
(74) *Attorney, Agent, or Firm* — WPAT, PC

(57) ABSTRACT

A signal processing method includes: driving multiple backlight zones to emit respectively; detecting multiple first luminance values corresponding to the backlight zones when each of the backlight zones emits; calculating a diffusion matrix according to the first luminance values; obtaining multiple first correction signals corresponding to the backlight zones according to the diffusion matrix and multiple target luminance values corresponding to the backlight zones; and controlling the backlight zones to display according to the first correction signals respectively.

9 Claims, 9 Drawing Sheets

Z1

| | | | | | | | | | | |
|---|---|---|---|---|---|---|---|---|---|---|
| $l(1,1)$ | $l(1,2)$ | $l(1,3)$ | $l(1,4)$ | $l(1,5)$ | $l(1,6)$ | ... | ... | ... | ... | $l(1,11)$ |
| $l(1,12)$ | $l(1,13)$ | ... | ... | ... | ... | ... | ... | ... | ... | $l(1,22)$ |
| $l(1,23)$ | ... | ... | ... | ... | ... | ... | ... | ... | ... | $l(1,33)$ |
| ⋮ | ... | ... | ... | ... | ... | ... | ... | ... | ... | ⋮ |
| ⋮ | ... | ... | ... | ... | ... | ... | ... | ... | ... | ⋮ |
| $l(1,56)$ | ... | ... | ... | ... | ... | ... | ... | ... | ... | $l(1,66)$ |

Fig. 5A

Z2

| | | | | | | | | | | |
|---|---|---|---|---|---|---|---|---|---|---|
| $l(2,1)$ | $l(2,2)$ | $l(2,3)$ | $l(2,4)$ | $l(2,5)$ | $l(2,6)$ | ... | ... | ... | ... | $l(2,11)$ |
| $l(2,12)$ | $l(2,13)$ | ... | ... | ... | ... | ... | ... | ... | ... | $l(2,22)$ |
| $l(2,23)$ | ... | ... | ... | ... | ... | ... | ... | ... | ... | $l(2,33)$ |
| ⋮ | ... | ... | ... | ... | ... | ... | ... | ... | ... | ⋮ |
| ⋮ | ... | ... | ... | ... | ... | ... | ... | ... | ... | ⋮ |
| $l(2,56)$ | ... | ... | ... | ... | ... | ... | ... | ... | ... | $l(2,66)$ |

Fig. 5B

Z3

| | | | | | | | | | | |
|---|---|---|---|---|---|---|---|---|---|---|
| $l(3,1)$ | $l(3,2)$ | $l(3,3)$ | $l(3,4)$ | $l(3,5)$ | $l(3,6)$ | ... | ... | ... | ... | $l(3,11)$ |
| $l(3,12)$ | $l(3,13)$ | ... | ... | ... | ... | ... | ... | ... | ... | $l(3,22)$ |
| $l(3,23)$ | ... | ... | ... | ... | ... | ... | ... | ... | ... | $l(3,33)$ |
| ⋮ | ... | ... | ... | ... | ... | ... | ... | ... | ... | ⋮ |
| ⋮ | ... | ... | ... | ... | ... | ... | ... | ... | ... | ⋮ |
| $l(3,56)$ | ... | ... | ... | ... | ... | ... | ... | ... | ... | $l(3,66)$ |

Fig. 5C

| | | | | | | | | | | |
|---|---|---|---|---|---|---|---|---|---|---|
| $l(66,1)$ | $l(66,2)$ | $l(66,3)$ | $l(66,4)$ | $l(66,5)$ | $l(66,6)$ | ... | ... | ... | ... | $l(66,11)$ |
| $l(66,12)$ | $l(66,13)$ | ... | ... | ... | ... | ... | ... | ... | ... | $l(66,22)$ |
| $l(66,23)$ | ... | ... | ... | ... | ... | ... | ... | ... | ... | $l(66,33)$ |
| ⋮ | ... | ... | ... | ... | ... | ... | ... | ... | ... | ⋮ |
| ⋮ | ... | ... | ... | ... | ... | ... | ... | ... | ... | ⋮ |
| $l(66,56)$ | ... | ... | ... | ... | ... | ... | ... | ... | ... | $l(66,66)$ |

Z66

Fig. 5D

SIGNAL PROCESSING METHOD AND DISPLAY DEVICE

RELATED APPLICATIONS

This application claims priority to Taiwan Application Serial Number 108101872, filed Jan. 17, 2019, which is herein incorporated by reference.

BACKGROUND

Technical Field

The disclosure relates to a signal processing method, particularly to a signal processing method and a display device for adjusting backlight brightness.

Description of Related Art

With development of technology, the demand for display devices becomes more and more extensive. The uniformity of brightness of liquid crystal displays (LCDs) is limited by the design of liquid crystal molecules and backlight architectures.

Therefore, how to improve the uniformity of display brightness is the current design considerations and challenges.

SUMMARY

One aspect of the present disclosure is a signal processing method, including: driving multiple backlight zones to emit respectively; detecting multiple first luminance values corresponding to the backlight zones when each of the backlight zones emits; calculating a diffusion matrix according to the first luminance values; obtaining multiple first correction signals corresponding to the backlight zones according to the diffusion matrix and multiple target luminance values corresponding to the backlight zones; and controlling the backlight zones to display according to the first correction signals respectively.

Another aspect of the present disclosure is a display device. The display device includes a backlight component and a processor. The backlight component includes multiple backlight zones. The processor is coupled to the backlight component. The processor is configured to: drive the backlight zones to emit respectively to obtain a plurality of first luminance values, wherein the first luminance values are detected corresponding to the backlight zones when each of the backlight zones emitting respectively; calculate a diffusion matrix according to the first luminance values; obtain a plurality of first correction signals corresponding to the backlight zones according to the diffusion matrix and a plurality of target luminance values corresponding to the backlight zones; and control the backlight component to display according to the first correction signals.

BRIEF DESCRIPTION OF THE DRAWINGS

FIG. 5A, FIG. 5B, FIG. 5C and FIG. 5D are schematic diagram illustrating brightness of a backlight component in accordance with some embodiments of the disclosure.

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the diagrams, some of the conventional structures and elements are shown with schematic illustrations.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

In this document, the term "coupled" may also be termed "electrically coupled," and the term "connected" may be termed "electrically connected." "Coupled" and "connected" may also be used to indicate that two or more elements cooperate or interact with each other.

Figure 1:
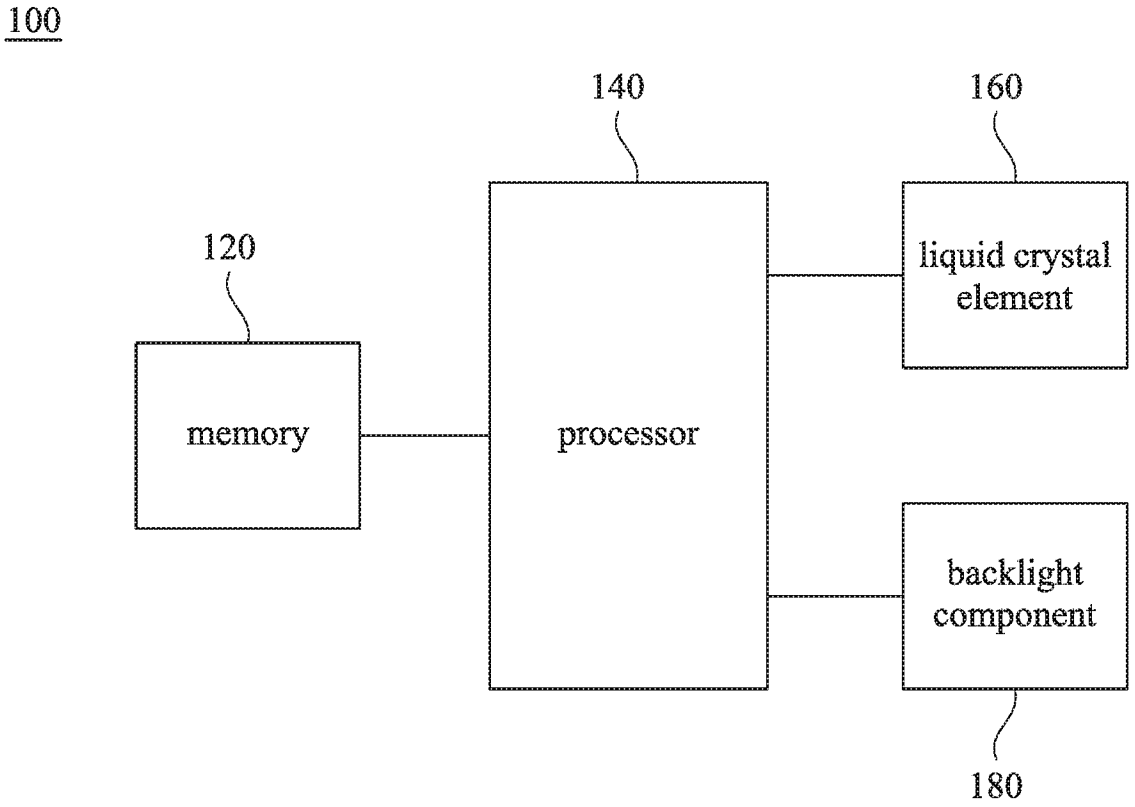
FIG. 1 is a schematic diagram illustrating a display device in accordance with some embodiments of the disclosure.

Please refer to FIG. 1. FIG. 1 is a schematic diagram illustrating a display device 100 in accordance with some embodiments of the disclosure. As shown in FIG. 1, display device 100 includes a memory 120, a processor 140, a liquid crystal element 160 and a backlight component 180. In structure, the processor 140 is coupled to the memory 120, liquid crystal element 160 and the backlight component 180. In configurationally, the backlight component 180 is configured to output backlight. The liquid crystal element 160 is configured to display output images. The processor 140 is configured to receive input image signals and to detect luminance values, and to obtain correction signals by a signal processing method, and then to control the liquid crystal element 160 and the backlight component 180 to display according to the input image signals and correction signals.

Specifically, the processor 140 is configured to receive input image signals, to adjust the input image signals by high dynamic range (HDR) algorithm, and to obtain correction signals by the signal processing method to improve the uniformity of backlight. When it is going to display, the processor 140 is configured to generate corresponding output driving signals according to the correction signals and to output the output driving signals to the liquid crystal element 160 and the backlight component 180. The liquid crystal element 160 and the backlight component 180 are configured to display according to the corresponding driving signals respectively. About the signal processing method will be described in the following paragraphs.

In some embodiments, the processor 140 may be realized by various processing circuit, a micro controller, a center processor, a microprocessor, a digital signal processor (DSP), an application specific integrated circuit (ASIC), a complex programmable logic device (CPLD), a field-programmable gate array (FPGA) or logic circuit, etc.

Figure 2:
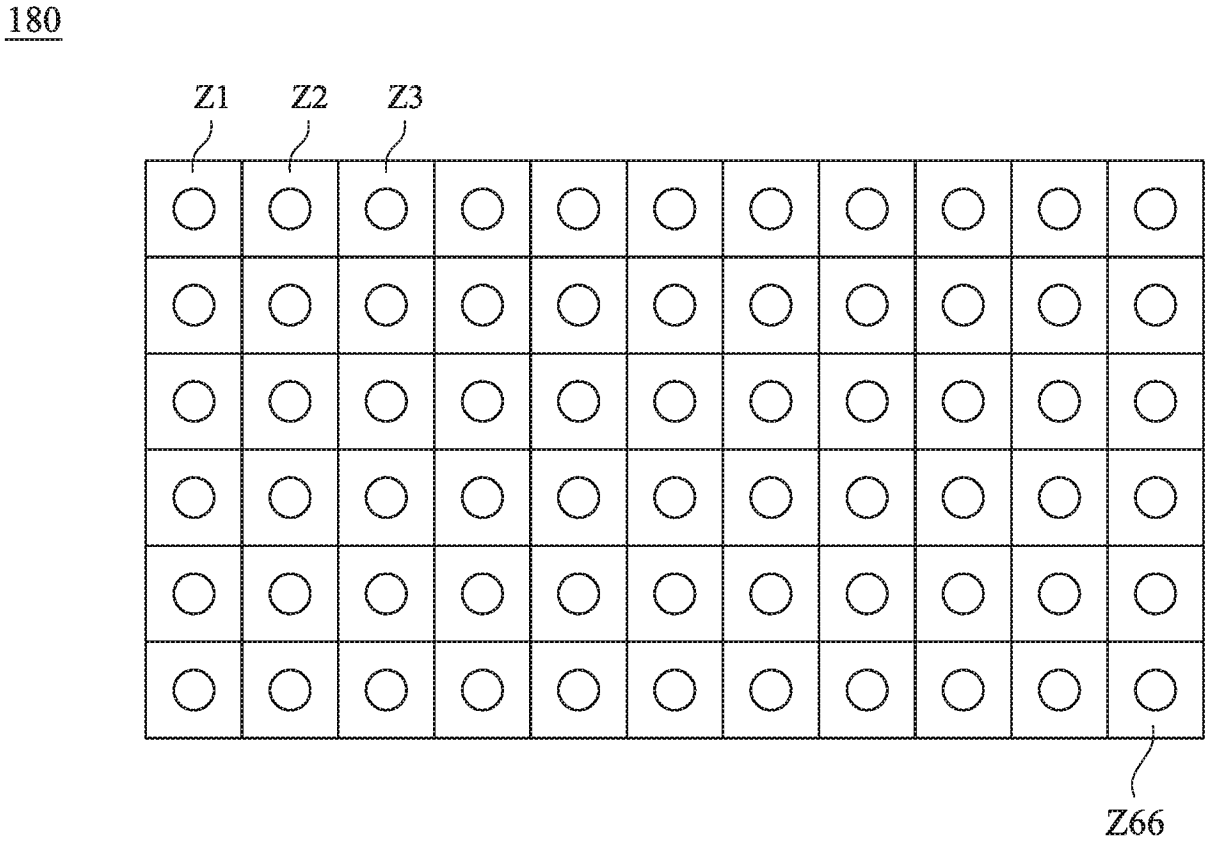
FIG. 2 is a schematic diagram illustrating a circuit of a backlight component in accordance with some embodiments of the disclosure.

Please refer to FIG. 2. FIG. 2 is a schematic diagram illustrating a circuit of a backlight component 180 in accordance with some embodiments of the disclosure. As shown in FIG. 2, the backlight component 180 includes multiple backlight zones, such as the backlight zones Z1, Z2, Z3 . . . Z66 illustrated in figure. In some embodiments, the number of backlight zones included by the backlight component 180 is n, in which n is any positive integer greater than 1. FIG. 2 is taken as an example, the backlight component 180 may include 11 rows and 6 columns, a total of 66 backlight zones Z1~Z66. In other words, n is 66.

It should be noted that the number or the size of the backlight zones included by the backlight component 180 may be adjusted based on actual needs. FIG. 2 is merely taken as an example, and not intended to limit to the present disclosure. For the convenience and clarity of explanation, the backlight component 180 includes 66 backlight zones Z1~Z66 as an example in the following paragraphs.

Figure 3A:
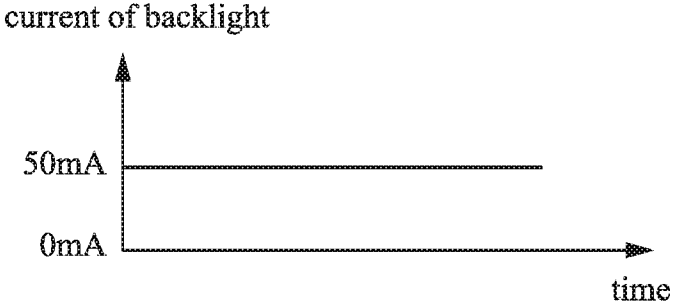
FIG. 3A and FIG. 3B are schematic diagrams illustrating backlight driving signals in accordance with some embodiments of the disclosure.
Figure 3B:
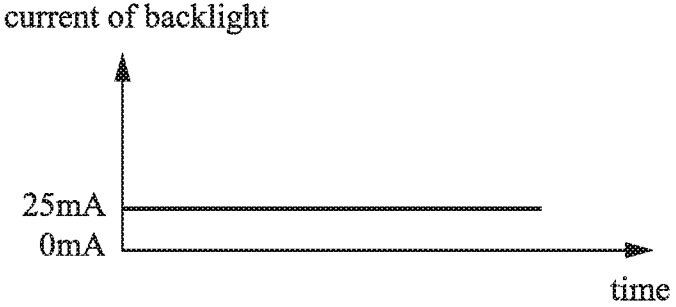
Figure 3C:
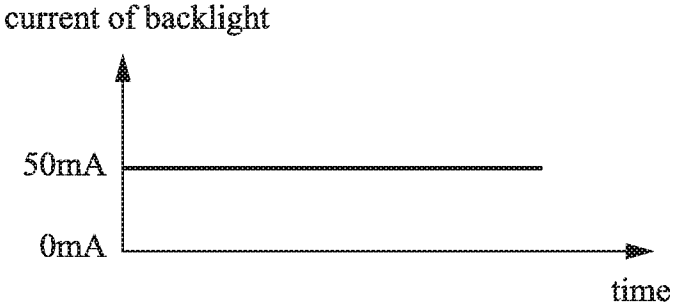
FIG. 3C and FIG. 3D are schematic diagrams illustrating another backlight driving signals in accordance with other embodiments of the disclosure.
Figure 3D:
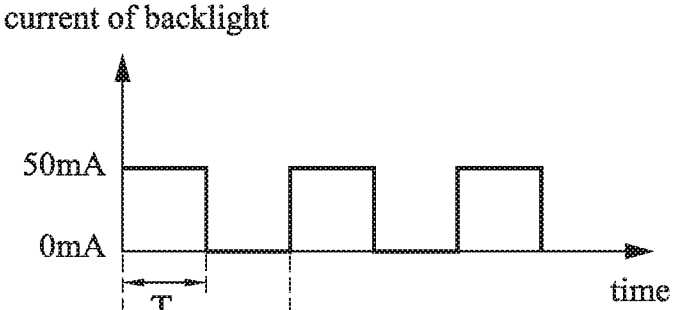

Please refer to FIG. 3A, FIG. 3B, FIG. 3C and FIG. 3D. FIG. 3A and FIG. 3B are schematic diagrams illustrating backlight driving signals in accordance with some embodiments of the disclosure. FIG. 3C and FIG. 3D are schematic diagrams illustrating another backlight driving signals in accordance with other embodiments of the disclosure. The method for adjusting the illumination brightness of each backlight zone Z1~Z66 of the backlight component 180 may include directly adjusting the current signal for driving the backlight, or adjusting the switching frequency of the backlight current to change the pulse width modulation (PWM) signal of the backlight current.

For example, in some embodiments, the current signals for driving the backlight may be 50 mA and 25 mA as shown in FIG. 3A and FIG. 3B respectively. In some other embodiments, the pulse width modulation (PWM) signal for driving the backlight current may be 100% as shown in FIG. 3C, or may be about 50% as T2/T1 shown in FIG. 3D.

For the convenience and clarity of explanation, the specific operations of each unit in the display device 100 will be disclosed with the embodiment using the current signals as the driving signals for the backlight component 180 and with accompanying schematic diagrams for detailed description. The other embodiments using pulse width modulation (PWM) signal as driving signal for the backlight component 180 will be described in the following paragraphs.

Figure 4:
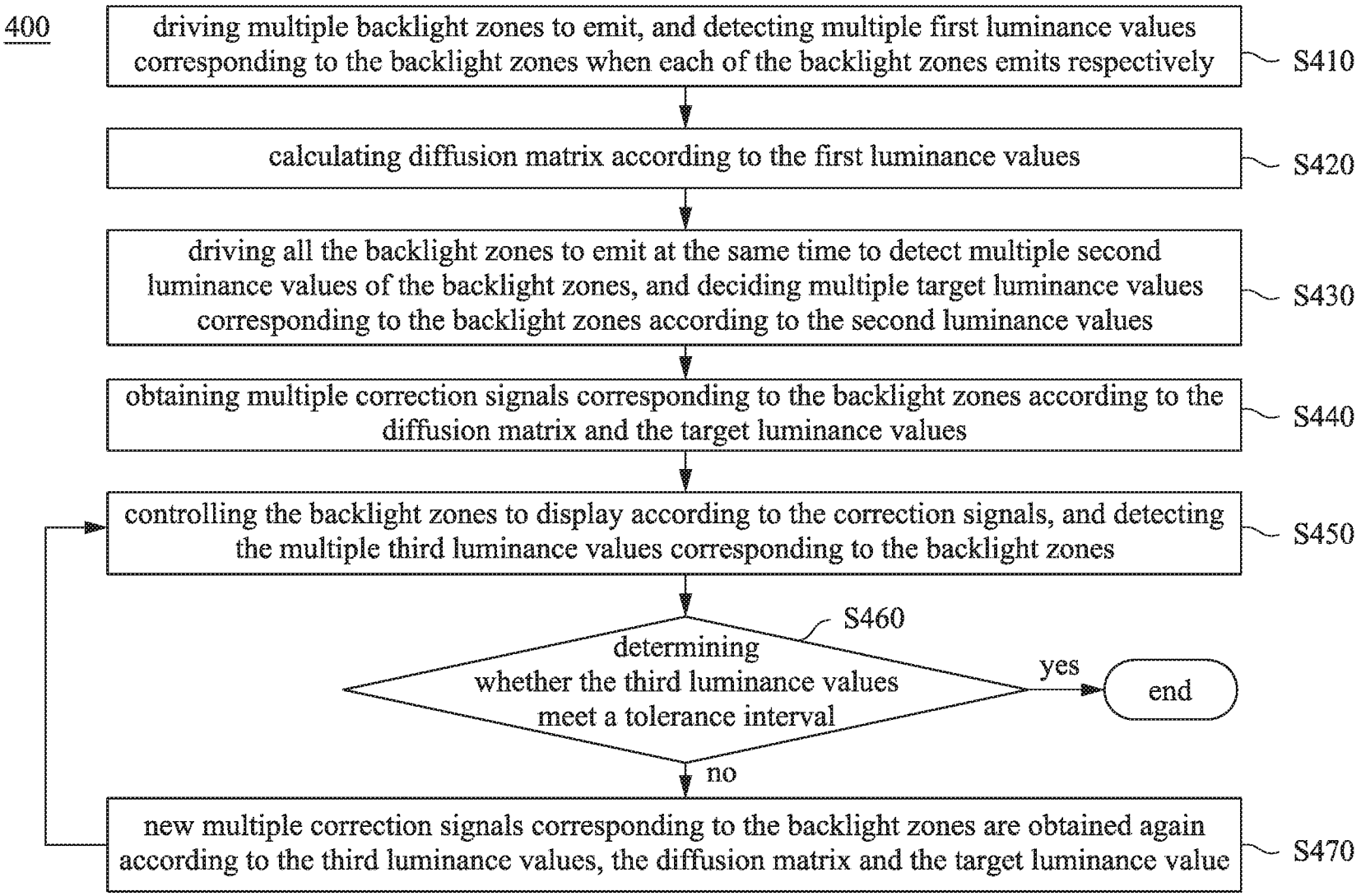
FIG. 4 is a flow chart illustrating a signal processing method in accordance with some embodiments of the disclosure.

Please refer to FIG. 4. FIG. 4 is a flow chart illustrating a signal processing method 400 in accordance with some embodiments of the disclosure. The following signal processing method 400 is described in accompanying with the embodiments shown in FIG. 1 and FIG. 2, but not limited thereto. Various alterations and modifications may be performed on the disclosure by those of ordinary skilled in the art without departing from the principle and spirit of the disclosure. As shown in FIG. 4, the signal processing method 400 includes operations S410, S420, S430, S440, S450, S460 and S470.

Firstly, in operation S410, driving multiple backlight zones Z1~Z66 to emit, and detecting multiple first luminance values l(1,1)~l(66,66) corresponding to the backlight zones Z1~Z66 when each of the backlight zones Z1~Z66 emits respectively.

Specifically, please refer to FIG. 5A, FIG. 5B, FIG. 5C and FIG. 5D. FIG. 5A, FIG. 5B, FIG. 5C and FIG. 5D are schematic diagram illustrating brightness of the backlight component 180 in accordance with some embodiments of the disclosure. In FIGS. 5A-5D, the emitting zones are marked with diagonal lines. In operation S410, the processor 140 lights up backlight zones Z1~Z66 separately with initial signals (e.g., initial current values). For example, as shown in FIG. 5A, the processor 140 individually lights up the backlight zone Z1 with the initial current value. And then, as shown in FIG. 5B, the processor 140 individually lights up the backlight zone Z2 with the initial current value. So as on, the processor 140 individually lights up the backlight zone Z66 with the initial current value as shown in FIG. 5D.

When the backlight zone Z1 individually emits according to the initial current value, the brightness corresponding to the backlight zones Z1~Z66 is detected to obtain first luminance values l(1,1)~l(1,66), as shown in FIG. 5A. When the backlight zone Z2 individually emits according to the initial current value, the brightness corresponding to the backlight zones Z1~Z66 is detected to obtain first luminance values l(2,1)~l(2,66), as shown in FIG. 5B. When the backlight zone Z3 individually emits according to the initial current value, the brightness corresponding to the backlight zones Z1~Z66 is detected to obtain first luminance values l(3,1)~l(3,66), as shown in FIG. 5C. So as on, when the backlight zone Z66 individually emits according to the initial current value, the brightness corresponding to the backlight zones Z1~Z66 is detected to obtain first luminance values l(66,1)~l(66,66), as shown in FIG. 5D.

In other words, when the processor 140 individually drives the backlight zone Zn to emit, the first luminance value l(n,m) corresponding to the backlight zone Zm is obtained. In this way, by the processor 140 individually driving each backlight zone Z1~Zn to emit, and recording the luminance values of the light diffusing to each backlight zone Z1~Zm in the backlight component 180, the brightness contributed by each of the backlight zones Z1~Zn to all backlight zones Z1~Zm is obtained.

Next, please refer back to FIG. 4. In operation S420, calculating diffusion matrix according to the first luminance values l(1,1)~l(66,66).

Specifically, because one zone of the backlight component 180 emits, the light will diffuse to each zone of the backlight component 180 with different levels. In other words, the relationship between the current signal for driving a certain zone of the backlight component 180 to emit and the luminance values detected corresponding to each zone may be represented by a diffusion value, as shown in the equation (1).

$$l(n,m)=d(n,m)\times k\times In \quad (1)$$

'In' represents the current value driving the backlight zone Zn to emit. 'k' represents a conversion factor. 'l(n,m)' represents the luminance value of the backlight zone Zm when the backlight zone Zn emits individually. 'd(n,m)' represents the diffusion value between the l(n,m) and In.

Therefore, in operation S420, the processor 140 receives the detected first luminance values l(1,1)~l(66,66), and deduces to the corresponding multiple diffusion values d(1,1)~d(66,66) according to the first luminance values l(1,1)~l(66,66) by the equation (1) to build a diffusion matrix.

About how to obtain the diffusion matrix, the further description is explained here. In some embodiments, the corresponding first luminance values l(1,m)~l(n,m) of the backlight zone Zm when the backlight zones Z1~Zn emits respectively with the initial current value are summed up as a total luminance value Lom, as shown in the equation (2-1).

$$Lom=l(1,m)+l(2,m)+l(3,m)+\ldots+1(n,m) \tag{2-1}$$

For example, when n=1~66, m=1, as shown in the equation (2-2), the total luminance value Lo1 is by summed up the corresponding first luminance values l(1,1)~l(66,1) of the backlight zone Z1 when the backlight zones Z1~Z66 emits respectively.

$$Lo1=l(1,1)+l(2,1)+l(3,1)+\ldots+l(66,1) \tag{2-2}$$

In other words, total luminance value Lo1 is the sum of the first luminance value l(1,1) of the backlight zone Z1 when the backlight zone Z1 individually emits as shown in FIG. 5A; and the first luminance value l(2,1) of the backlight zone Z1 when the backlight zone Z2 individually emits as shown in FIG. 5B; and the first luminance value l(3,1) of the backlight zone Z1 when the backlight zone Z3 individually emits as shown in FIG. 5C; and so on the first luminance value l(66,1) of the backlight zone Z1 when the backlight zone Z66 individually emits as shown in FIG. 5D.

For another example, when n=1~66, m=2, the total luminance value Lo2 is by summed up the corresponding first luminance values l(1,2)~l(66,2) of the backlight zone Z2 when the backlight zones Z1~Z66 emits respectively. Therefore, and so on, when n=1~66, m=66, the total luminance value Lo66 is by summed up the corresponding first luminance values l(1,66)~l(66,66) of the backlight zone Z2 when the backlight zones Z1~Z66 emits respectively.

Accordingly, the equation (3-1) may be obtained by induced by the equation (1) and equation (2-1). A total luminance matrix may be built according to the total luminance value Lo1~Lom as shown in the equation (3-2). For the concise description, it will be expressed in matrix form, as shown in the equation (3-3).

$$Lom = k[d(1,m)\ d(2,m)\ \ldots\ d(n,m)]\cdot\begin{bmatrix} I1 \\ I2 \\ \vdots \\ In \end{bmatrix} \tag{3-1}$$

$$\begin{bmatrix} Lo1 \\ Lo2 \\ \vdots \\ Lom \end{bmatrix} = k\begin{bmatrix} d(1,1) & d(2,1) & \ldots & d(n,1) \\ d(1,2) & d(2,2) & & d(n,2) \\ \vdots & & \ddots & \vdots \\ d(1,m) & d(2,m) & \ldots & d(n,m) \end{bmatrix}\cdot\begin{bmatrix} I1 \\ I2 \\ \vdots \\ In \end{bmatrix} \tag{3-2}$$

$$\mathcal{L} = k\cdot\mathcal{D}\cdot i \tag{3-3}$$

'L' represents the total luminance matrix including total luminance values Lo1~Lom. 'i': represents an initial signal matrix including the current signals I1~In for driving each of the backlight zones Z1~Zn to emit. '$\mathcal{D}$' represents the diffusion matrix including the corresponding diffusion values d(1,1)~d(n,m).

Next, equation (4-1) is obtained by matrix operations according to equation (3-3)

$$\begin{aligned} &\mathcal{L} = k\cdot\mathcal{D}\cdot i \\ &\Rightarrow \frac{1}{k}\cdot\mathcal{L}\cdot i^{-1} = \mathcal{D}\cdot i\cdot i^{-1} \\ &\Rightarrow \mathcal{D} = \frac{1}{k}\cdot\mathcal{L}\cdot i^{-1} \end{aligned} \tag{4-1}$$

Therefore, by substituting into equation (4-1) the initial current values for driving the backlight zones Z1~Z66 to emit and the total luminance values Lo1~Lo66 obtained by summing up, the diffusion matrix is able to be obtained, as shown in the equation (4-2). 'Io' is the initial current value.

$$\mathcal{D} = \frac{1}{k}\begin{bmatrix} Lo1 \\ Lo2 \\ \vdots \\ Lo66 \end{bmatrix}\cdot\begin{bmatrix} Io \\ Io \\ \vdots \\ Io \end{bmatrix}^{-1} \tag{4-2}$$

In other words, the total luminance values Lo1~Lom corresponding to backlight zones are obtained by summing up the first luminance values l(1,1)~l(n,m) detected according to each backlight zone Z1~Zm when all the backlight zones Z1~Zn emit respectively. And the diffusion matrix may be calculated according to the initial current value for driving each backlight zone to emit separately and the corresponding total luminance values Lo1~Lom.

Next, please refer back to FIG. 4. In operation S430, driving all the backlight zones Z1~Z66 to emit at the same time to detect multiple second luminance values b1~b66 of the backlight zones Z1~Z66, and deciding multiple target luminance values Lt1~Lt66 corresponding to the backlight zones Z1~Z66 according to the second luminance values b1~b66.

Figure 6:
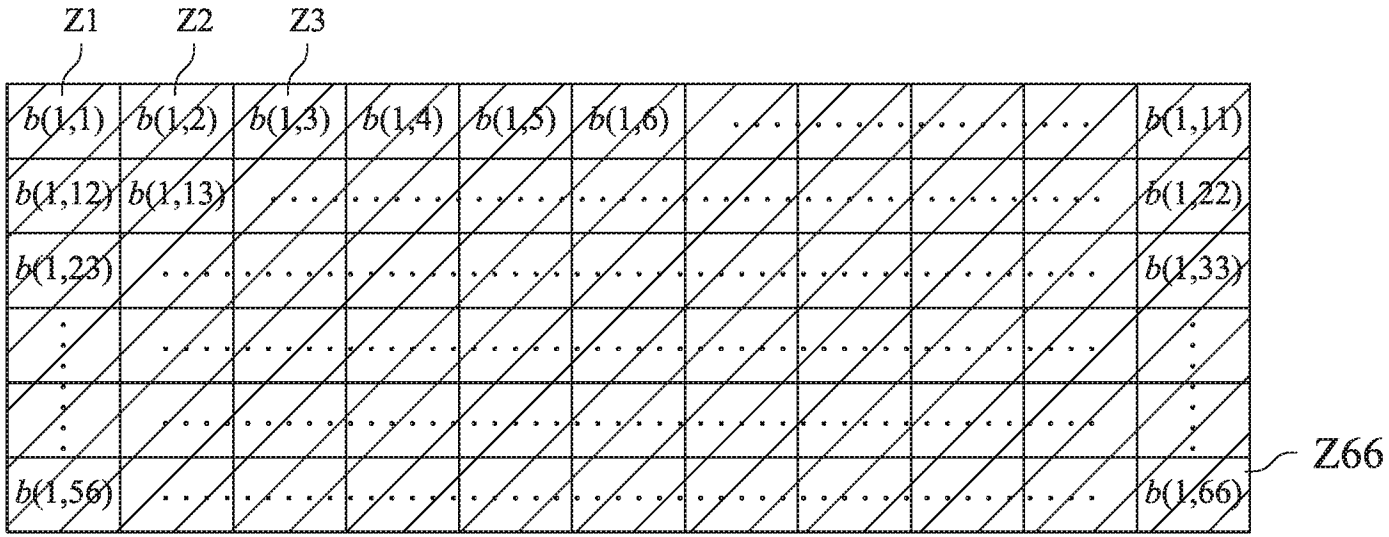
FIG. 6 is a schematic diagram illustrating brightness of another backlight component in accordance with other embodiments of the disclosure.

Specifically, the processor 140 drives all the backlight zones Z1~Z66 to emit with the initial current value Io, as shown in FIG. 6, the emitting area is indicated by slash. When all the backlight zones Z1~Z66 emit, the brightness corresponding to the backlight zones Z1~Z66 is detected to obtain the second luminance values b(1,1)~b(1,66). The processor 140 receives the second luminance values b(1,1)~b(1,66), and decides the target luminance values Lt1~Lt66 corresponding to the backlight zones Z1~Z66 according to the minimum value of the second luminance values b(1,1)~b(1,66). About how to decide the target luminance values will be described in following paragraphs.

Next, please keep referring to FIG. 4. In operation S440, obtaining multiple correction signals S11~S1*n* corresponding to the backlight zones Z1~Z66 according to the diffusion matrix and the target luminance values Lt1~Lt66. Specifically, the processor 140 calculates the corrected current values in the correction signals S11~S1*n* according to the inner product of the inverse matrix of the diffusion matrix and the target luminance values Lt1~Lt66.

For example, the processor 140 may obtain the equation (5) by matrix operation according to the equation (3-2).

$$\begin{aligned} &\mathcal{L} = k\cdot\mathcal{D}\cdot i \\ &\Rightarrow \frac{1}{k}\cdot\mathcal{D}^{-1}\cdot\mathcal{L} = \mathcal{D}^{-1}\cdot\mathcal{D}\cdot i \\ &\Rightarrow i = \frac{1}{k}\cdot\mathcal{D}^{-1}\cdot\mathcal{L} \end{aligned} \tag{5}$$

Therefore, the inverse matrix may be calculated according to the diffusion matrix obtained by operation S420. By substituting into the equation (5) the inverse matrix of the diffusion matrix and the target luminance values Lt1~Lt66 obtained by operation S430, the corrected current value is obtained as shown in the equation (6). 'Ir1~Ir66' represent the corrected current values corresponding to backlight zones Z1~Z66.

$$\begin{bmatrix} Ir1 \\ Ir2 \\ \vdots \\ Ir66 \end{bmatrix} = \frac{1}{k}\begin{bmatrix} d(1,1) & d(2,1) & \dots & d(n,1) \\ d(1,2) & d(2,2) & & d(n,2) \\ \vdots & & \ddots & \vdots \\ d(1,m) & d(2,m) & \dots & d(n,m) \end{bmatrix}^{-1} \cdot \begin{bmatrix} Lt1 \\ Lt2 \\ \vdots \\ Lt66 \end{bmatrix} \tag{6}$$

Next, in operation S450, controlling the backlight zones Z1~Z66 to display according to the correction signals S11~S1*n*, and detecting the multiple third luminance values La1~La66 corresponding to the backlight zones Z1~Z66. Specifically, the processor 140 outputs the correction signals S11~S1*n* obtained according to the S440 to the corresponding backlight zones Z1~Z66 to control the backlight zones Z1~Z66 to display. When the backlight zones Z1~Z66 emit, the brightness corresponding to the backlight zones Z1~Z66 is detected to obtain the third luminance values La1~La66.

Next, in operation S460, determining whether the third luminance values La1~La66 meet a tolerance interval. Specifically, the processor 140 sets upper and lower limits of the error tolerance values above and below the target luminance values Lt1~Lt66 according to a specified value. The tolerance interval is between the upper limit of the error tolerance value and the lower limit of the error tolerance value. For example, when the target luminance value is 800 nits, the tolerance interval may be about 795~805 nits. This is merely an example, the range of the tolerance interval and the size of the tolerance value may be based on actual needs, not intended to limit to it.

When the third luminance values La1~La66 meet the tolerance interval, indicating that the backlight component 180 has been adjusted to be uniform enough for each backlight zones, the signal processing method 400 may be ended. On the other hand, when the third luminance values La1~La66 do not meet the tolerance interval, the operation S470 is performed again to adjust the backlight component 180.

In operation S470, new multiple correction signals S21~S2*n* corresponding to the backlight zones Z1~Z66 are obtained again according to the third luminance values La1~La66, the diffusion matrix and the target luminance values Lt1~Lt66. Specifically, the processor 140 subtracts the target luminance values Lt1~Lt66 and third luminance values La1~La66 to build an error matrix. And the processor 140 takes the inner product of the inverse matrix of the diffusion matrix and the error matrix to calculate a compensation matrix including multiple compensation values.

For example, as shown in the equation (7), the third luminance values La1~La66, the inverse matrix of the diffusion matrix and the target luminance values Lt1~Lt66 are substituted into the equation (7) to calculate the compensation matrix. 'Ic1~Ic66' represents the compensation values corresponding to the backlight zones Z1~Z66.

$$\begin{bmatrix} Ic1 \\ Ic2 \\ \vdots \\ Ic66 \end{bmatrix} = \frac{1}{k}\begin{bmatrix} d(1,1) & d(2,1) & \dots & d(n,1) \\ d(1,2) & d(2,2) & & d(n,2) \\ \vdots & & \ddots & \vdots \\ d(1,m) & d(2,m) & \dots & d(n,m) \end{bmatrix}^{-1} \cdot \left( \begin{bmatrix} Lt1 \\ Lt2 \\ \vdots \\ Lt66 \end{bmatrix} - \begin{bmatrix} La1 \\ La2 \\ \vdots \\ La66 \end{bmatrix} \right) \tag{7}$$

Next, the processor 140 substitutes the corrected current values Ir1~Ir66 corresponding to the backlight zones Z1~Z66 and the initial current Io into the equation (8) to obtain the new corrected current values.

$$Irn' = \left( \frac{Irn}{Io} + \frac{Icn}{Irn} \right) \times Irn \tag{8}$$

'Irn' is the corrected current value corresponding to the backlight zone Zn, which is obtained through the first calculation. 'Icn' is the compensation value corresponding to the backlight zone Zn. 'Irn" is the new corrected current value corresponding to the backlight zone Zn.

Next, as shown in FIG. 4, after the new corrected current values Ir1'~Ir66' are obtained by the operation S470, the operation S450 is performed again. In operation S450, controlling the corresponding backlight zones Z1~Z66 to display according to the correction signals including new corrected current values Ir1'~Ir66', and detecting the new luminance values again. In this way, by updating the correction signals with the luminance values detected last time, the actual luminance values will be convergence to the target luminance values.

Figure 7:
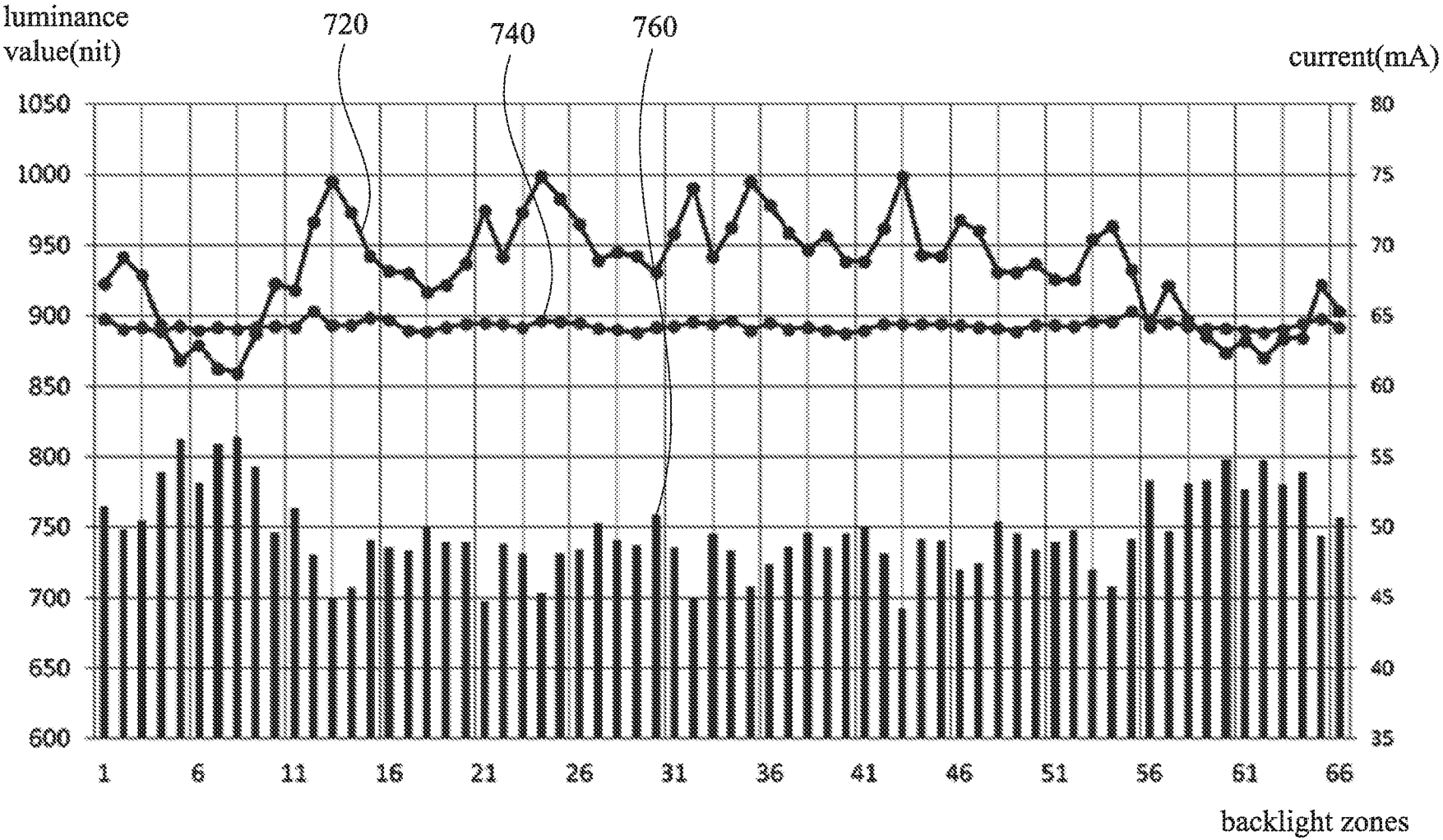
FIG. 7 is a test result chart illustrating a signal processing method in accordance with some embodiments of the disclosure.

Please refer to FIG. 7. FIG. 7 is a test result chart illustrating a signal processing method 400 in accordance with some embodiments of the disclosure. In the embodiments of FIG. 7, the signal for driving the backlight component 180 to emit is a current signal. The second luminance values b(1,1)~b(1,66) are shown as curve 720 in figure. The corrected current values Ir1~Ir66 obtained corresponding to correction signals S11~S66 of the backlight zones Z1~Z60 by the signal processing method 400 are shown as curve 740 in figure. When the backlight zones Z1~Z66 are controlled to display according to the correction signals S11~S66, the detected third luminance values La1~La66 corresponding to the backlight zones Z1~Z6 are shown as curve 760 in figure.

Regarding the setting of the target luminance values Lt1~Lt66, since the current signal is used as the driving signal for the backlight component 180, the luminance values outputted by backlight zones Z1~Z60 of the backlight component 180 may be directly adjusted by adjusting the amplitude of the current signal. Therefore, the target luminance values Lt1~Lt66 may be set to slightly higher than the lowest of second luminance values b(1,1)~b(1,66). For example, as shown in FIG. 7, the lowest value of the second luminance values b(1,1)~b(1,66) is about 855 nits. Therefore, the target luminance values Lt1~Lt66 may be set to about 900 nits or any value lower than 900 nits.

In addition, in some other embodiments, the signals driving the backlight component 180 to emit are pulse width modulation signals. In the present embodiment, compared to the embodiment of using the current signals as the driving signals for the backlight component 180, the operations in the signal processing method 400 are similar. For the convenience and clarity of explanation, the differences from the above embodiments will be described, and the details thereof will not be described again.

Please refer to FIG. 4. Firstly, in operation S410, emitting the backlight zones Z1~Z66 respectively by the processor 140 with the initial signals (i.e., initial pulse width modulation signal), and recording the first luminance values l(1,1)~l(66,66) of the light diffusing to backlight zones Z1~Zm in the backlight component 180. For example, the processor 140 may use 100% as the initial pulse width modulation value.

Next, in operation S420, substituting into the equation (4-1) the initial pulse width modulation values for driving the backlight zones Z1~Z66 to emit and the total luminance values Lo1~Lo66 obtained by summing up, then the diffusion matrix is able to be obtained as shown in the equation (9). 'Po' is the initial pulse width modulation value.

$$\mathcal{D} = \frac{1}{k}\begin{bmatrix} Lo1 \\ Lo2 \\ \vdots \\ Lo66 \end{bmatrix} \cdot \begin{bmatrix} Po \\ Po \\ \vdots \\ Po \end{bmatrix}^{-1} \tag{9}$$

Next, in operation S430, driving all backlight zones Z1~Z66 to emit by the processor 140 with the initial pulse width modulation value Io, and recording the second luminance values b(1,1)~b(1,66).

Next, in operation S440, substituting into the equation (5) the inverse matrix of the diffusion matrix and the target luminance values Lt1~Lt66 by the processor 140, the correction signals may be obtained. The correction signals include the corrected pulse width modulation values Pr1~Pr66 corresponding to the backlight zones Z1~Z66 as show in the equation (10).

$$\begin{bmatrix} Pr1 \\ Pr2 \\ \vdots \\ Pr66 \end{bmatrix} = \frac{1}{k}\begin{bmatrix} d(1,1) & d(2,1) & \dots & d(n,1) \\ d(1,2) & d(2,2) & & d(n,2) \\ \vdots & & \ddots & \vdots \\ d(1,m) & d(2,m) & \dots & d(n,m) \end{bmatrix}^{-1} \cdot \begin{bmatrix} Lt1 \\ Lt2 \\ \vdots \\ Lt66 \end{bmatrix} \tag{10}$$

Next, in operation S450, outputting the corresponding signals to the backlight zones Z1~Z66 to control the backlight zones Z1~Z66 to display again according to the corrected pulse width modulation values Pr1~Pr66 in the correction signals S11~S1*n* by the processor 140, and recording the third luminance values La1~La66.

Next, in operation S460, determining whether the third luminance values La1~La66 meet the tolerance interval.

When the third luminance values La1~La66 do not meet the tolerance interval, the operation S470 is performed, substituting into the equation (11) the third luminance values La1~La66, the inverse matrix of the diffusion matrix and the target luminance values Lt1~Lt66 to calculate the compensation matrix. 'Pc1~Pc66' represents the compensation values corresponding to the backlight zones Z1~Z66.

$$\begin{bmatrix} Pc1 \\ Pc2 \\ \vdots \\ Pc66 \end{bmatrix} = \frac{1}{k}\begin{bmatrix} d(1,1) & d(2,1) & \dots & d(n,1) \\ d(1,2) & d(2,2) & & d(n,2) \\ \vdots & & \ddots & \vdots \\ d(1,m) & d(2,m) & \dots & d(n,m) \end{bmatrix}^{-1} \cdot \left( \begin{bmatrix} Lt1 \\ Lt2 \\ \vdots \\ Lt66 \end{bmatrix} - \begin{bmatrix} La1 \\ La2 \\ \vdots \\ La66 \end{bmatrix} \right) \tag{11}$$

Next, the processor 140 substitutes into the equation (12) the corrected pulse width modulation values Pr1~Pr66 corresponding to the backlight zones Z1~Z66 and the initial pulse width modulation values Po to obtain the new corrected pulse width modulation value Prn'.

$$Prn' = \left(\frac{Prn}{Po} + \frac{Pcn}{Prn}\right) \times Prn \tag{12}$$

Next, as shown in FIG. 4, after the new corrected pulse width modulation values Pr1'~Pr66' obtained in the operation S470, the operation S450 is performed again. In the operation S450, controlling the corresponding backlight zones Z1~Z66 to display according to the correction signals including the new corrected pulse width modulation values Pr1'~Pr66', and detecting the new luminance values again. In this way, by updating the correction signals by the last measured luminance values, the actual luminance values are be able to converge toward the target luminance values.

Figure 8:
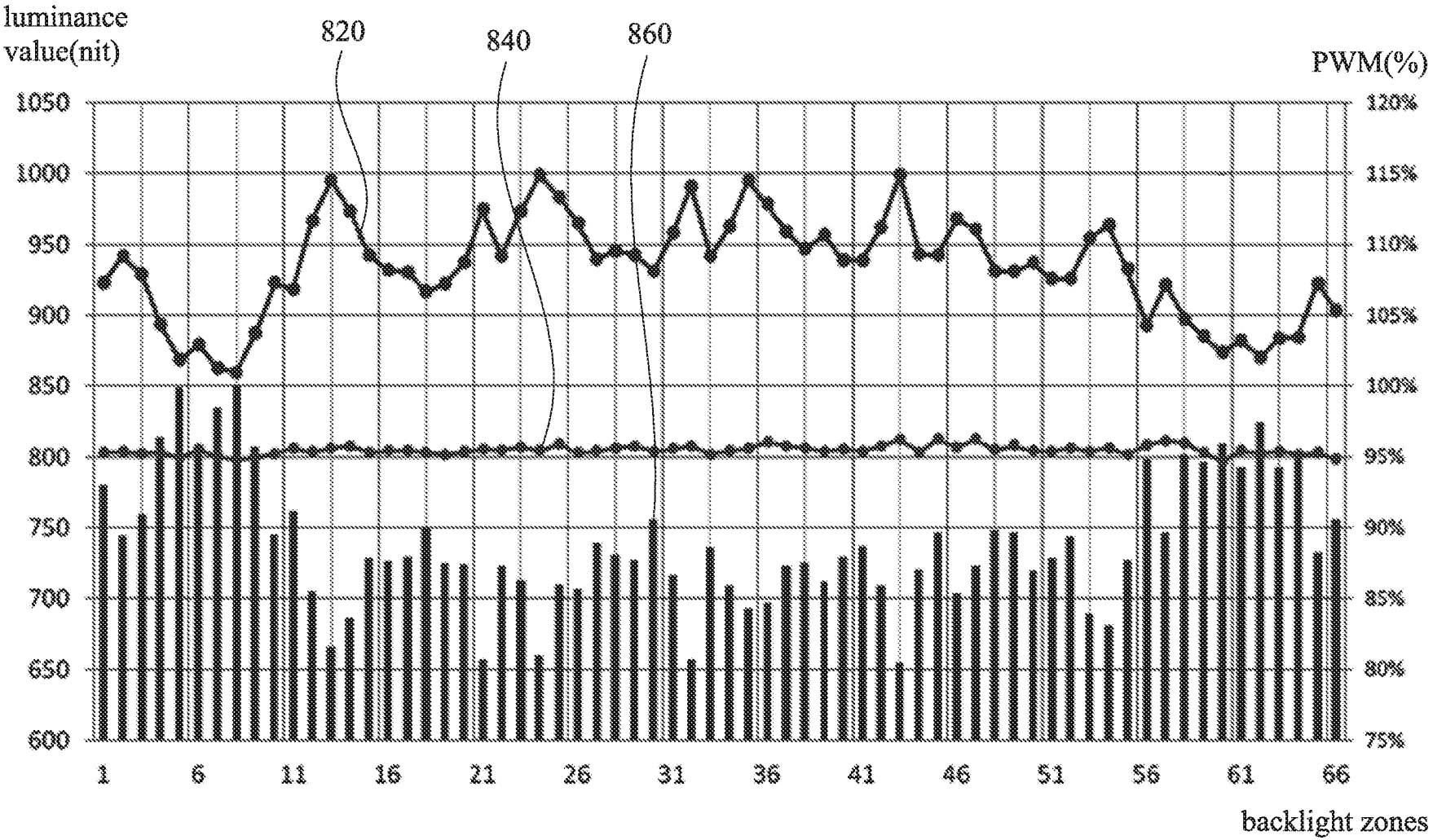
FIG. 8 is a test result chart illustrating another signal processing method in accordance with other embodiments of the disclosure.

Please refer to FIG. 8. FIG. 8 is a test result chart illustrating another signal processing method 400 in accordance with other embodiments of the disclosure. In the embodiments of FIG. 8, the signals for driving the backlight component 180 to emit are pulse width modulation signals. The second luminance values b(1,1)~b(1,66) recorded by driving all backlight zones Z1~Z66 to emit with the initial pulse width modulation value Io are shown as curve 820 in figure. The corrected pulse width modulation values Pr1~Pr66 corresponding to the correction signals S11~S66 of the backlight zones Z1~Z60 obtained by the signal processing method 400 are shown as curve 840 in figure. When the backlight zones Z1~Z66 are controlled according to the correction signals S11~S66 to display, the third luminance values La1~La66 detected corresponding to the backlight zones Z1~Z66 are shown as curve 860 in figure.

Regarding to the setting of the target luminance values Lt1~Lt66, since the pulse width modulation signals as the driving signals for the backlight component 180, the maximum value of the signal is 100%. And when the second luminance values b(1,1)~b(1,66) are the brightness recorded by taking 100% as the initial pulse width modulation values to drive all backlight zones Z1~Z66 to emit, the maximum value in the target luminance values Lt1~Lt66 may be set as the lowest value in the second luminance values b(1,1)~b(1,66). For example, as shown in FIG. 8, the minimum value of the second luminance values b(1,1)~b(1,66) is about 855 nits. Therefore, the target luminance values Lt1~Lt66 may be set about 850 nits or any value lower than 850 nits. In the embodiments of FIG. 8, the target luminance values Lt1~Lt66 are about 800 nits.

It should be noted that, the current values and the pulse width modulation values as the driving signals for the backlight component 180 may be converted by the equation (13).

$$Pk = \frac{Ik}{Imax} \times 100\% \tag{13}$$

'Ik' is the current value for driving the backlight component 180. 'Imax' is the maximum current value for driving the backlight component 180. 'Pk' is the pulse width modulation values corresponding to 'Ik'. For example, when the maximum value Imax for driving the backlight component 180 as shown in FIG. 3A is 50 mA, and the current value Ik as shown in FIG. 3B is 25 mA, the corresponding pulse width modulation value Pk obtained by the equation (13) is 25/50=50%, as shown in FIG. 3D. In this way, when the brightness of the backlight is adjusted by the signal processing method 400, the current signal and/or the pulse width modulation signal may be obtained according to actual needs to drive the backlight component 180.

It should be noted that the sequence of execution of the processes in the foregoing flowcharts is merely an exemplary embodiment, not intended to limit to the present disclosure. Various alterations and modifications may be performed on the disclosure by those of ordinary skills in the art without departing from the principle and spirit of the disclosure. For example, in some embodiments, the signal processing method 400 may be omitted the operation S430, and determined the target luminance values by the total luminance value summed up in the operations S420. For another example, in some embodiments, the signal processing method 400 may not be included the operations S460 and S470.

In the foregoing, exemplary operations are included. However, these operations do not need to be performed sequentially. The operations mentioned in the embodiment may be adjusted according to actual needs unless the order is specifically stated, and may even be performed simultaneously or partially simultaneously.

It is noted that, the drawings, the embodiments, and the features and circuits in the various embodiments may be combined with each other as long as no contradiction appears. The circuits illustrated in the drawings are merely examples and simplified for the simplicity and the ease of understanding, but not meant to limit the present disclosure. In addition, those skilled in the art can understand that in various embodiments, circuit units may be implemented by different types of analog or digital circuits or by different chips having integrated circuits. Components may also be integrated in a single chip having integrated circuits. The description above is merely by examples and not meant to limit the present disclosure.

In summary, in various embodiments of the present disclosure, by separately lighting the backlight zones in different locations and detecting the luminance values of the light diffused to all backlight zones to obtain the diffusion matrix, and then calculating the corrected current values and/or the corrected pulse width modulation values required to reach the target brightness by the diffusion matrix, so that the uniformity of backlight brightness is able to be improved.

Although specific embodiments of the disclosure have been disclosed with reference to the above embodiments, these embodiments are not intended to limit the disclosure. Various alterations and modifications may be performed on the disclosure by those of ordinary skills in the art without departing from the principle and spirit of the disclosure. Thus, the protective scope of the disclosure shall be defined by the appended claims.

What is claimed is:

1. A signal processing method, comprising:

driving a plurality of backlight zones to emit respectively, wherein the number of the backlight zones is n;

obtaining a plurality of first luminance values corresponding to the backlight zones, wherein one of the first luminance values l(i,m) is obtained by measuring a brightness of a backlight zone Zm when a backlight zone Zi is individually lighted up, wherein m≤n;

summing up the first luminance values obtained by individually lighting up the backlight zones to obtain a plurality of corresponding total luminance values Lom, wherein $$Lom=\Sigma_{i=1}^{n}l(i,m);$$

building a total luminance matrix L according to the total luminance values, wherein $$L=\begin{bmatrix} Lo1 \\ Lo2 \\ \vdots \\ Lon \end{bmatrix};$$

and calculating a diffusion matrix by an equation as follow:

$$D=1/k\cdot L\cdot i^{-1};$$

wherein D is the diffusion matrix; i represents an initial signal matrix including a plurality of current signals for lighting up the backlight zones; and k represents a conversion factor;

obtaining a plurality of first correction signals corresponding to the backlight zones according to the diffusion matrix and a plurality of target luminance values corresponding to the backlight zones; and controlling the backlight zones to display according to the first correction signals respectively.

2. The signal processing method of claim 1, further comprising:

driving the backlight zones to emit at the same time to detect a plurality of second luminance values corresponding to the backlight zones; and determining the target luminance values according to the second luminance values.

3. The signal processing method of claim 2, wherein the target luminance values are smaller than or equal to the corresponding second luminance values.

4. The signal processing method of claim 1, further comprising:

detecting a plurality of third luminance values corresponding to the backlight zones when the backlight zones are controlled to display according to the first correction signals; and determining whether the third luminance values meet a tolerance interval.

5. The signal processing method of claim 4, further comprising:

obtaining a plurality of second correction signals corresponding to the backlight zones according to the third luminance values, the diffusion matrix and the target luminance values when the third luminance values do not meet the tolerance interval; and controlling the backlight zones to display according to the second correction signals.

6. The signal processing method of claim 5, wherein obtaining the second correction signals comprises:

subtracting the corresponding third luminance values from the target luminance values to establish an error matrix;

taking an inner product of the error matrix and an inverse matrix of the diffusion matrix to obtain a plurality of compensation values; and calculating the corresponding second correction signals according to the first correction signals and the corresponding compensation values.

7. The signal processing method of claim 1, wherein the first correction signals correspondingly comprises a plurality of corrected current values, the corrected current values are obtained according to an inner product of the target luminance values and an inverse matrix or the diffusion matrix.

8. The signal processing method of claim 7, wherein the first correction signals correspondingly comprises a plurality of pulse width modulation values, any one of the pulse width modulation values is obtained according to a proportion of the corresponding one of the corrected current values and the corresponding one of a plurality of initial signals.

9. A display device, comprising:

a backlight component, comprising n backlight zones; and a processor, coupled to the backlight component, the processor configured to:

drive the backlight zones to emit respectively to obtain a plurality of first luminance values, wherein one of the first luminance values l(i,m) is obtained by measuring a brightness of a backlight zone Zm when a backlight zone Zi is individually lighted up, wherein m≤n;

summing up the first luminance values obtained by individually lighting up the backlight zones to obtain a plurality of corresponding total luminance values Lom, wherein $$Lom=\Sigma_{i=1}^{n}l(i,m);$$

building a total luminance matrix L according to the total luminance values, wherein $$L=\begin{bmatrix} Lo1 \\ Lo2 \\ \vdots \\ Lon \end{bmatrix};$$

and calculating a diffusion matrix by an equation as follow:

$$D=1/k\cdot L\cdot i^{-1};$$

wherein D is the diffusion matrix; i represents an initial signal matrix including a plurality of current signals for lighting up the backlight zones; and k represents a conversion factor;

obtain a plurality of first correction signals corresponding to the backlight zones according to the diffusion matrix and a plurality of target luminance values corresponding to the backlight zones; and control the backlight component to display according to the first correction signals.

* * * * *